US007266208B2

(12) United States Patent
Charvin et al.

(10) Patent No.: US 7,266,208 B2
(45) Date of Patent: Sep. 4, 2007

(54) AUDITORY AID DEVICE FOR THE REHABILITATION OF PATIENTS SUFFERING FROM PARTIAL NEUROSENSORY HEARING LOSS

(75) Inventors: Guy Charvin, Antibes (FR); Stéphane Gallego, Juan-les-Pins (FR)

(73) Assignee: MXM, Vallauris (FR)

( * ) Notice: Subject to any disclaimer, the term of this patent is extended or adjusted under 35 U.S.C. 154(b) by 191 days.

(21) Appl. No.: 10/519,123

(22) PCT Filed: Jun. 19, 2003

(86) PCT No.: PCT/FR03/01889

§ 371 (c)(1),
(2), (4) Date: Aug. 15, 2005

(87) PCT Pub. No.: WO04/002193

PCT Pub. Date: Dec. 31, 2003

(65) Prior Publication Data

US 2006/0015155 A1 Jan. 19, 2006

(30) Foreign Application Priority Data

Jun. 21, 2002 (FR) ..... 02 07738

(51) Int. Cl.
*H04R 25/00* (2006.01)

(52) U.S. Cl. ..... 381/328; 381/322; 381/326

(58) Field of Classification Search ..... 381/312, 381/322, 326–328, 324, 330, 331, 380–382; 600/25; 607/55–57; 181/129, 130, 135
See application file for complete search history.

(56) References Cited

U.S. PATENT DOCUMENTS 4,419,995 A * 12/1983 Hochmair et al. ..... 607/57
4,606,329 A * 8/1986 Hough ..... 600/25
6,084,975 A * 7/2000 Perkins ..... 381/326

* cited by examiner

*Primary Examiner*—Huyen Le
(74) *Attorney, Agent, or Firm*—Daphne L. Burton

(57) ABSTRACT

The invention concerns a hearing aid comprising: an outer housing (1) containing a signal processing module (11) connected in input to at least a microphone (13) and in output to an earphone for transmitting a sound signal into the patient's external auditory canal (5); at least one first magnetic component (12) arranged in the outer housing (1); at least one second magnetic component (21) arranged in an implantable housing designed to be implanted under the patient's skin, at a site where the outer housing (1) can be maintained, the first magnetic component being arranged in the outer housing such that a magnetic attraction force is exerted with the second magnetic component when the outer housing (1) is placed at said site; and a device for delivering sound signals into the patient's external auditory canal comprising the earphone and a connection (4) between the outer housing (1) and the auditory canal.

19 Claims, 2 Drawing Sheets

AUDITORY AID DEVICE FOR THE REHABILITATION OF PATIENTS SUFFERING FROM PARTIAL NEUROSENSORY HEARING LOSS

CROSS-REFERENCE TO RELATED APPLICATIONS

This application claims priority to French patent application No. 0207738 filed on or about Jun. 21, 2002. A related application was also filed under the Patent Cooperation Treaty on or about Jun. 19, 2003, as PCT/FR03/01889. The PCT application claims priority to the French patent application.

BACKGROUND OF THE INVENTION

1. Field of the Invention

The invention relates to an acoustic auditory aid for the rehabilitation of partial neurosensory hearing loss.

2. Description of the Related Art

At the present time, acoustic auditory aids available on the market are classified in two product categories: ear contour devices and intra-auricular devices.

Ear contour devices comprise a casing in the shape of an arc of a circle meant to be lodged behind the ear, this casing generally containing one or more sensors such as microphones, an energy source of the cell or battery type, and electronic circuits for analog and/or digital signal amplification and processing. The electronic circuits generate an acoustic signal that is sent into the auditory canal of the patient through an acoustic tube held in the auditory canal by an intra-auricular plug.

This intra-auricular plug, moreover, makes it possible to reduce acoustic Larsen phenomena between the earpiece and the point of sound emission.

Beyond the fact that the ear contour devices are standardized, these devices present great ease of implementation, high reliability and adequate performance characteristics, due in part to the relatively large available volume, making it possible to integrate all necessary electronic circuits. However, these devices present the disadvantage of being painful to wear, and of posing a threat of falling consequent to certain movements of the head. Moreover, they are relatively visible and lack esthetics. They do not make it possible to totally eliminate Larsen phenomena on account of the fact that the microphone is relatively close to the earpiece, which obliges them to be adjusted in a sub-amplification mode. In addition, the intra-auricular plug also presents disadvantages, in particular the disagreeable sensation of blocked up ear, perception of parasitical sounds during chewing, and problems of hygiene and potentially of infections, due to the fact that it plugs the auditory canal.

As far as the second category of devices available on the market is concerned, intra-auricular devices present themselves in the form of small casings meant to be inserted directly in the external auditory canal. This casing is made of a synthetic resin shell, whose shape is fitted by molding to the anatomy of the external auditory canal of each patient. This casing brings together, in a highly reduced volume, the sound sensor, the electronic signal amplification and processing circuits, the earphone, the energy source (electric cell). Compared to the ear contour devices, they present the advantage of being notably less visible and compact. On the other hand, they generate significant Larsen phenomena, both mechanical and acoustic, due to the proximity of the microphone and the earphone, which obliges them to be adjusted to a sub-amplification mode even lower than the ear contour devices. The miniaturization of the microphone and the earphone does not make it possible to obtain acoustic qualities of high quality.

Moreover, the low available volume makes difficult, indeed impossible, the addition of supplementary microphones or of more sophisticated signal processing functions. It presents low autonomy due to the use of an electric cell necessarily of small dimensions. On account of its small size, its manipulation, in particular during adjustments and battery changes, is difficult, which leads to risks of dropping during its withdrawal from the auditory canal. As with the ear contour devices, they cause disagreeable sensations of blocked up ear, raise hygiene problems, with risks of infection and premature wearout of the device.

SUMMARY OF THE INVENTION

This invention has the purpose of doing away with these disadvantages. This objective is attained by the provision of an acoustic auditory aide device, generating at least an acoustic signal and meant to be fixed to the body of a patient, this device comprising an external casing containing an electronic module for signal processing connected at the input to at least one microphone and at the output to an earphone designed to emit an acoustic signal into the external auditory canal of the patient, and an energy source.

According to the invention, this device further comprises:

- at least one first magnetic piece arranged in the external casing,
- at least one second magnetic piece arranged in an implantable casing designed to be implanted under the patient's skin, at a location of the body where the external casing is to be kept, the first magnetic piece being arranged in the external casing so that a magnetic force of attraction is exerted on the second magnetic piece when the external casing is placed at said location, and
- a device for distribution of acoustic signals in the auditory canal of the patient comprising the earphone, and a connection between the external casing and the auditory canal of the patient, with a length such that the microphone can be kept sufficiently distant from the auditory canal to avoid larsen phenomena.

Advantageously, the first magnetic piece is a magnet.

More preferably, the second magnetic piece is a magnet.

According to a characteristic of the invention, the first and second magnetic pieces are permanent magnets, and the second magnetic piece is arranged in the implanted casing in such a way as to present a north-south magnetic axis substantially parallel to the surface of the skin of the patient at said location, and the first magnetic piece is arranged in the external casing in such a way as to present a north-south magnetic axis substantially parallel to the wall of the casing intended to come in contact with the skin of the patient.

According to a first preferred variant of the invention, the second magnetic piece is a magnet and the first magnetic piece includes two permanent magnets arranged in the external casing so as to present north-south magnetic axes substantially perpendicular to the wall of the casing intended to come in contact with the skin of the patient, and in opposite directions, these magnetic axes being spaced apart by a distance substantially corresponding to the distance between the poles of the second magnetic piece.

According to a second preferred variant of the invention, the first magnetic piece is a magnet and the second magnetic piece includes two permanent magnets arranged in the implanted casing so as to present north-south magnetic axes substantially perpendicular to the surface of the skin of the patient at said location, and in opposite directions, these magnetic axes being spaced apart by a distance substantially corresponding to the distance between the poles of the first magnetic piece.

According to a third preferred variant of the invention, the second magnetic piece includes at least two permanent magnets arranged in the implanted casing so as to present north-south magnetic axes substantially perpendicular to the surface of the skin of the patient at said location, and alternatively in opposite directions, and the first magnetic piece includes as many permanent magnets as the first piece, the magnets of the first magnetic piece being arranged in the casing so as to present north-south magnetic axes substantially perpendicular to the wall of the external casing intended to come in contact with the skin of the patient, and alternatively in opposite directions, the magnetic axes of the magnets arranged in the external casing being distributed in a plane substantially parallel to said wall in a configuration substantially corresponding to the distribution configuration of the magnetic axes of the magnets in the implanted casing.

According to a characteristic of the invention, the second casing is designed to be implanted in the temporal-occipital area of the patient's skull.

According to another characteristic of the invention, the earphone is arranged in the external casing and connected to the external auditory canal of the patient by an acoustic tube comprising an intra-auricular end, the auditory aid device comprising additionally a mechanical anti-larsen absorption system.

Alternatively, the earphone is placed in the external auditory canal of the patient and forms an intra-auricular end of the connection, the connection being made up by an electric cable.

Advantageously, the intra-auricular end of the connection is held in the external auditory canal of the patient by means of an intra-auricular support comprising means for centering and supporting said end in the auditory canal.

According to another characteristic of the invention, the external casing includes a base and a cover rotatably mounted on the base, and means for fixing the angular position of the cover with respect to the base, the second magnetic piece being fixed to the base, whereas the microphone(s) are fixed to the cover.

According to still another characteristic of the invention, the implanted casing is connected to at least two electrodes for collection of evoked or spontaneous auditory potentials, the implanted casing enclosing at least an electronic module for signal collection and processing connected to the collection electrodes, a transmission module connected to an antenna and to the module for collection and processing, in order to transmit the signals produced by the collection module to the external casing, as a function of the signals collected by the electrodes, and an electrical supply.

Most preferably, one of the collection electrodes is designed to be arranged on the round window.

According to another characteristic of the invention, the implanted casing is also connected to at least an active stimulation electrode designed to be positioned in proximity to the inner ear of the patient or in the cochlea, the implanted casing enclosing at least an electronic stimulation module connected to the stimulation electrodes, a transmission module connected to an antenna and to the stimulation module, the stimulation module being designed to generate electrical signals that are applied to the stimulation electrodes from signals received from the external casing through the transmission module, via the antenna located in the implanted casing.

Most preferably, one of the active stimulation electrodes is designed to be arranged on the round window of the patient's middle ear.

Advantageously, the collection electrodes and the stimulation electrodes are at least partially common.

According to still another characteristic of the invention, the external casing includes additionally a signals transmission module connected to at least an antenna and to the electronic module.

Advantageously, the implanted casing is additionally connected to at least an electromechanical transducing vibrator designed to be positioned in a bony or cartilaginous area in proximity to the inner ear of the patient, the implanted casing enclosing at least an electronic stimulation module connected to the vibrator, a transmission module connected to an antenna and to the transmission module, the stimulation module being designed to generate electrical stimulation signals that are applied to the vibrator from signals received from the external casing through the transmission module, via the antenna located in the implanted casing.

BRIEF DESCRIPTION OF THE DRAWINGS

A preferred embodiment of the invention will be described in the following, as an illustration but not limited to it, with reference to the appended drawings in which.

DETAILED DESCRIPTION OF THE INVENTION

Figure 1:
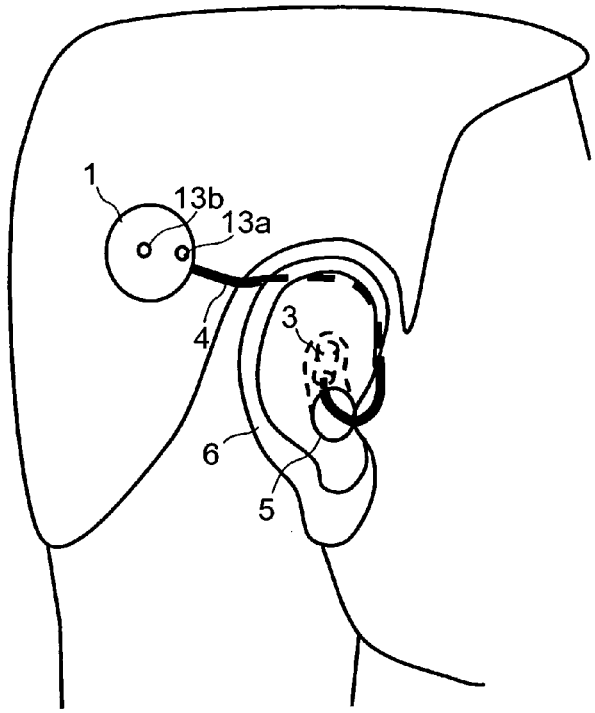
FIG. 1 schematically shows, in partial profile view, the head of a patient equipped with an auditory aid according to the invention.
Figure 2:
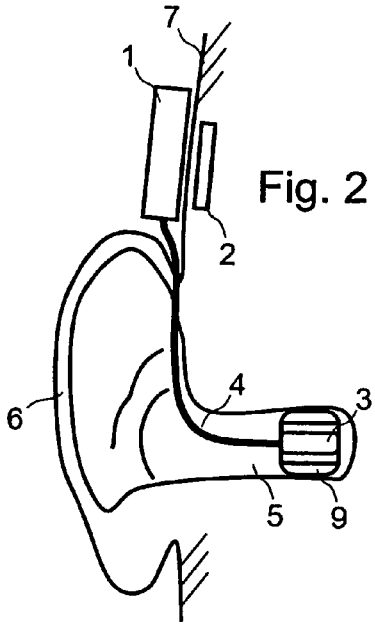
FIG. 2 shows a cross-sectional view of a part of the head of the patient shown in FIG. 1, equipped with the auditory aid according to the invention.

FIGS. 1 and 2 show, in profile view and cross-sectional view respectively, the head of a patient equipped with an auditory aid device according to the invention, supported on the skull. This device comprises an external casing 1 equipped with at least a microphone 13*a*, 13*b* and enclosing an energy source (for example an electric cell or battery), and the electronic circuits for signal amplification and processing, this casing being connected to an acoustic signals distribution device in the auditory canal 5 of the patient, this device comprising an earphone 3 and a connection 4 between the casing and the inner space of the auditory canal. As shown in FIG. 2, which shows in cross-section the ear 6 and the auditory canal 5 of the patient, as well as part of the skull 7, the casing 1 is supported according to the invention on the patient's head by means of a magnet lodged in a casing 2 implanted under the skin and possibly fixed to the bone of the skull 7, this magnet being designed to exert a magnetic force of attraction on a magnetic piece arranged in the external casing, when the latter is arranged in proximity to the implanted casing 2.

Casing 2 presents an substantially flat shape of low thickness, so that it can be inserted under the skin, most preferably under the scalp, in order to be masked by the patient's hair, even at an advanced stage of baldness. To this end, it is implanted for example on the mastoid bone or on the temporo-occipital bone as shown in FIG. 1.

By choosing a magnet of suitable force, the casing can be easily fixed on the patient's head and supported in all positions and during normal head movements. Under a functional aspect, the microphone(s) on casing 1 are sufficiently distant from the earphone, and separated by the pavilion of the ear, which serves as a screen between the reverberated sound coming from the external auditory canal and the microphone. As a result, the acoustic larsen effect between the reverberated sound coming from the external auditory canal arriving on the microphone(s) is very attenuated, indeed eliminated (according to the amplification and the opening of the tip sought) on account of the combination of the two means consisting on the one hand of the sufficient distance between the auditory canal and the microphone(s) located close to the temporal-occipital area, and on the other hand of the existence of a natural acoustic barrier formed by the pavilion of the ear.

Thanks to the progress in integration of electronic circuits, casing 1 can present a low thickness so as not to cause the appearance of added thickness when it is masked by the hair.

The connection 4 between casing 1 and earphone 3 is made by an electrical cable. In this case, the earphone includes an electroacoustic transducer designed to be inserted in the external auditory canal of the patient.

Alternatively, this connection 4 is an acoustic tube. In this case, the earphone is integrated in the external casing 1 and extended by the acoustic tube 4, which is watertight and presents a length suitable to reach the bottom of the patient's external auditory canal. In this case, the earphone contained in the casing is equipped with a mechanical anti-larsen absorption device (absorption of the vibrations generated by the earphone). It is to be noted that there is no acoustic larsen phenomenon because the acoustic waves generated by the earphone are canalized by the acoustic tube.

Most preferably the cable 4 is semi-rigid so as to precisely follow a predetermined path between casing 1 and the bottom of the external auditory canal, for example by tracing the outline of the ear by the upper part, and by supporting earphone 3 in a certain position in the external auditory canal. Thus, it is not necessary to close off the auricular canal by a plug in order to keep the earphone in place.

Figure 2A:
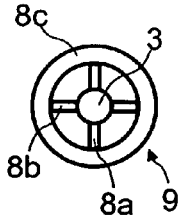
FIG. 2*a* shows an axial view of an intra-auricular earphone support, according to the invention.

Alternatively, the connection 4 can be flexible and earphone 3 or the end of the acoustic tube is supported and centered in the external auditory canal by an intra-auricular support 9. As shown in more detail in FIG. 2*a*, the intra-auricular support 9 includes a central housing designed to receive the earphone 3 or the end of the acoustic tube, this central housing being connected to an external tubular element 8*c* by the spacers 8*a*, 8*b*, delimiting with the external tubular element events making possible proper ventilation of the auditory canal.

The tubular element 8*c* is most preferably constructed out of a compressible and/or elastic material, or is molded as a function of the anatomy of the patient's auditory canal.

Compared to the prior art casings, the invention makes it possible to maintain an auditory aid device on the head of the patient in almost invisible way, only the connection 4 remaining visible, while being very discreet. Moreover, the almost complete absence of larsen makes it possible on one hand to increase the auditory performance characteristics of the patient by means of better amplification, and on the other hand, to reduce the problems of hygiene and of the phenomenon of occlusion (sensation of blocked up ear) resulting from the almost-blocking auricular plug, which can advantageously be replaced by the open auricular support 9.

Figure 3:
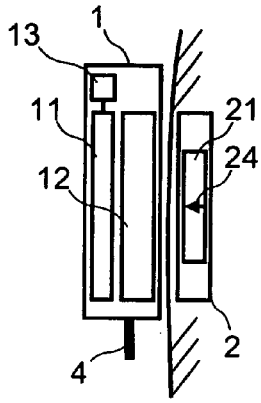
FIG. 3 shows in a more detailed view the prosthesis represented in FIG. 1 and the fixation device for the prosthesis according to the invention.

As shown in more detail in FIG. 3, the casing 1 encloses a magnetic piece 12, for example made of a ferromagnetic material, which is arranged against a surface of the casing so that it can be placed opposite and in proximity to the implanted casing 2, at the time of the installation of the prosthesis on the patient's head. The casing 1 also contains electronic circuits 11 powered by an electrical cell of low thickness (not shown), as well as a sensor 13 connected to the electronic circuits.

Of course, the piece made of ferromagnetic material can be housed in the implanted casing 2, and the magnet arranged in the casing 1.

In certain cases, the sensor 13 must be positioned according to an orientation specified with respect to the patient's head. As a matter of fact, certain auditory aid devices comprise a directional microphone or several omnidirectional microphones that must be oriented so as to restore information on the direction of the origin of the sounds, these microphones having to be positioned precisely so that the prosthesis can restore the exact information on the direction of origin of the sounds perceived.

Figure 4:
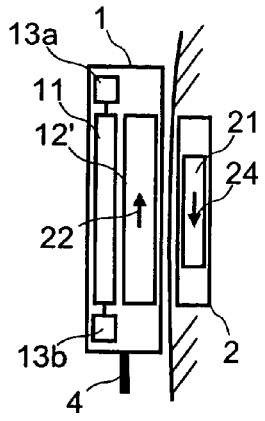
FIGS. 4 to 6 show three variants according to the invention of the device represented in detail in FIG. 3.

FIG. 4 shows an auditory prosthesis casing containing two microphones 13*a*, 13*b*. So that the casing and therefore the microphones can be arranged according to a precise orientation with respect to the patient's head, the permanent magnet 21 is implanted under the skin so as to present a north-south axis (shown in the figure by arrow 24) oriented in a certain direction parallel to the surface of the skull. In addition, the piece 12 housed in the casing 1 is replaced by a magnet 12', for example a permanent magnet whose north-south axis 22 is oriented in a predefined direction, parallel to the surface of the casing designed to be applied against the skin of the patient. In this way, the casing 1 can only be supported on the patient's head in a certain orientation.

Figure 5:
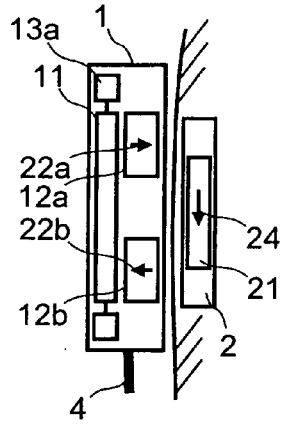

This result can also be obtained by means of the mode of realization shown in FIG. 5. In this figure, the permanent magnet 12', shown in FIG. 4, is replaced by two magnets 12*a*, 12*b* whose north-south axes 22*a*, 22*b* are oriented perpendicularly to the surface of the casing designed to be applied against the patient's skin, and in opposite directions. Moreover, the north-south axes 22*a*, 22*b* are spaced apart by a distance corresponding to the distance separating the north and south poles of the implanted magnet 2.

Figure 6:
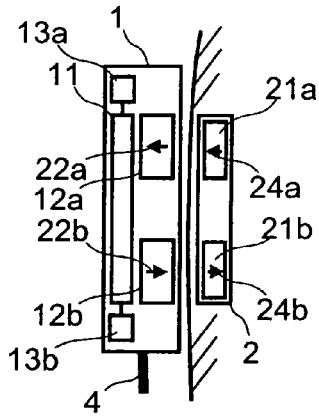

The casing 1 can also be supported on the patient's head in a certain predefined orientation thanks to the mode of realization shown in FIG. 6. In this mode of realization, the implanted casing 2 includes two magnets 21*a*, 21*b* whose north-south axes 24*a*, 24*b* are oriented perpendicularly to the surface of the skull, and in opposite directions. The casing 1 then contains a single magnet 12' as shown in FIG. 4, or two magnets 12*a*, 12*b* as shown in FIG. 5 or 6, these magnets being arranged in the casing so as to come opposite of an implanted magnet 21*a*, 21*b*, respectively, of the same orientation, when the casing 1 is placed according to the desired orientation on the patient's head.

It is also possible to provide for more than two magnets that are implanted and in the casing. These magnets are arranged so that their respective north-south axes are perpendicular to the surface of the patient's skin at the location where the casing is to be kept. Moreover, the various magnets must be distributed in the casing or fixed to it according to a configuration corresponding to that of the implanted magnets, respecting the polarity of the latter.

Figure 7:
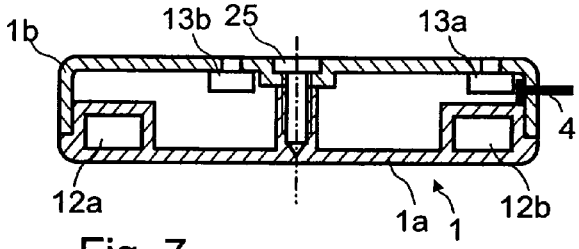
FIG. 7 shows a sectional view of another advantageous variant of the device according to the invention.
Figure 8:
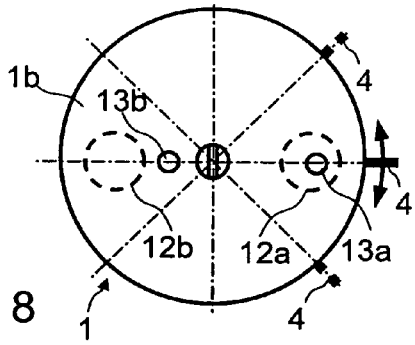
FIG. 8 shows a top view of the device represented in FIG. 7.

According to a preferred variant of the invention shown in FIGS. 7 and 8, the external casing 1 includes a base 1*a* of circular shape in which two magnets 12*a* and 12*b* are housed, and a cover 1*b* also of circular shape, in which the microphones 13*a*, 13*b* are fixed, and possibly the electronic circuits, and the energy source. The base 1*a* is supported on the patient's skull always in the same orientation, in keeping with one of the embodiments shown in FIGS. 4 to 6, as a function of the respective polarities of the magnetic pieces 21, 21*a*, 21*b*, while the cover 1*b* is pivotably mounted on the base 1*a*, and blocked in an angular position with respect to the latter by fixation means, for example consisting of a central screw 25 crossing the cover and screwed into a central pivot provided in the base 1*a*. In FIG. 7, it is to be noted that the magnets are totally isolated electrically in the base, so as to avoid any electrical contact with the electronic circuits housed in the cover.

FIG. 8 shows in interrupted lines three different positions of the cover with respect to the base (the cable 4 turns while the magnets 12*a*, 12*b* remain fixed).

The microphone(s) 13, 13*a*, 13*b* can thus be oriented optimally and with great precision by the practitioner responsible for the adjustment of the device or by the patient, after the implantation of the casing 2. In this way, possible inaccuracies of implantation of the implanted casing 2, resulting in particular from differences in morphology from one patient to another, can be avoided.

The patient can therefore arrange and withdraw the casing 1 very easily, always being assured that the microphones will be correctly oriented.

Of course, it is possible to provide for other modes of fixation of the cover to the casing (grooves, notches, contact plates, etc.) without departing from the scope of the invention.

Alternatively or in combination, the microphone(s) 13, 13*a*, 13*b* can also be arranged at the end of a respective rigid cable, connected to the external casing 1. If the cable can be shaped by the practitioner following the installation of the implanted casing 2, in order to correctly arrange and orient the microphone(s) with respect to the patient's head, it is not necessary that the external casing 1 presents a rotating part 1*b*.

Figure 9:
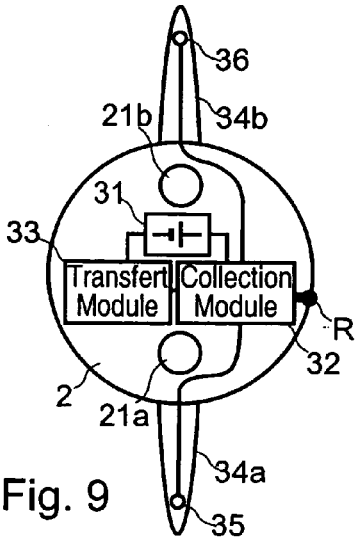
FIGS. 9 and 10 show two other variants of the implanted casing of the device according to the invention.

As shown in FIG. 9, the implanted casing 2 includes advantageously, in addition to the magnetic part(s) 21*a*, 21*b*, a system for collection of evoked or spontaneous auditory potentials. This system includes at least two extra-cochlear collection electrodes 35, 36 connected to the casing. This system also includes an electronic collection module 32 making it possible to amplify, and possibly to process signals coming from the electrodes, 35, 36, a transfer module 33 including in particular an emitting antenna to transmit to the outside for example by electromagnetic waves, via amplitude or frequency modulation, signals produced by the collection module 32, an electrical power supply 31 comprising a battery and/or coils trapping the electromagnetic energy coming from an outside coil for example provided for in the external casing 1. The casing 1 can also include a reception module connected to a coil/antenna to receive signals emitted by the transfer module 33. In this case, the outside coil and the antenna of the reception module can be fixed to the base 1*a* or to the cover 1*b* of the external casing.

At least one of the collection electrodes 35, 36 is designed to be implanted in proximity to the inner ear of the patient, most preferably on the round window. In this case, the collection module is designed to amplify and treat evoked or spontaneous acoustic potentials.

Alternatively, the collection electrodes 35, 36 are implanted under the patient's skin, also in the temporal-occipital region of the skull, to measure the evoked potentials and the collection module 32 is designed to amplify and possibly treat such potentials. To this end, the electrodes are for example arranged at the end of flexible strips 34*a*, 34*b* attached to the casing 2. In this case, a reference electrode R is also provided on the casing 2 and connected to the collection module 32.

Figure 10:
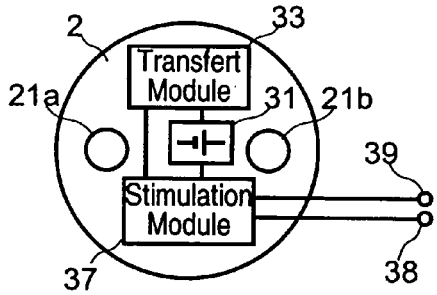

As shown in FIG. 10, the casing 2 contains, alternatively or in combination with the collection module 32, a stimulation module 37 connected to at least an active stimulation electrode 38, 39, implanted in proximity to the patient's inner ear, for example on the oval window or the round window of the middle ear, or in the cochlea as well. In the case of monopolar stimulation, the stimulation module 37 is connected to at least a neutral stimulation electrode distant from the inner ear. The stimulation module is designed to generate stimulation signals from signals received from the external casing 1 through the transfer module 33.

The electrodes 38, 39 can be replaced or combined with an electromechanical transducing vibrator, for example of the piezoelectric type, implanted in a bony or cartilaginous area, most preferably close to the patient's inner ear, to effect an electromechanical stimulation.

In the embodiment in which the implanted casing 2 comprises, in combination, the collection and stimulation devices, such as described with reference to FIGS. 9 and 10, the collection and stimulation electrodes are, according to an advantageous variant, common and can function alternatively in collection mode and stimulation mode. In this case, according to a preferred embodiment of the invention, one of the electrodes 38, 39 is positioned on the round window and is at the same time an active stimulation electrode, and alternatively, one of the electrodes for collection of auditory potentials.

The invention claimed is:

1. An acoustic auditory aid device, generating at least an acoustic signal and designed to be fixed to the body of a patient, comprising:

an external casing containing an electronic module for signal processing and having an input connected to at least one microphone and an output connected to an earphone designed to emit an acoustic signal in the external auditory canal of the patient, an energy source, at least one first magnetic part installed in the external casing, at least one second magnetic part installed in an implantable casing, designed to be implanted under the patient's skin, at a location of the body where the external casing is to be supported, the first magnetic part being installed in the casing so that a magnetic force of attraction is exerted on the second magnetic part when the external casing is placed at said location, and a device for distribution of acoustic signals in the auditory canal of the patient comprising the earphone, and a connection between the external casing and the auditory canal of the patient, with a length such that the microphone can be kept sufficiently distant from the auditory canal to avoid Larsen phenomena.

2. The auditory aid device according to claim 1, wherein the first magnetic part is a magnet.

3. The auditory aid device according to claim 1, wherein the second magnetic part is a magnet.

4. The auditory aid device according to claim 1, wherein the first and second magnetic parts are permanent magnets, and the second magnetic part being installed in the implanted casing so as to present a north-south magnetic axis substantially parallel to the surface of the patient's skin at said location, the first magnetic part being installed in the external casing so as to present a north-south magnetic axis substantially parallel to the wall of the casing designed to come in contact with the patient's skin.

5. The auditory aid device according to claim 1, wherein the second magnetic part is a magnet and the first magnetic part consists of two permanent magnets arranged in the external casing so as to present north-south magnetic axes substantially perpendicular to the wall of the casing designed to come in contact with the patient's skin, and in opposite directions, these magnetic axes being spaced apart by a distance substantially corresponding to the distance between the poles of the second magnetic part.

6. The auditory aid device according to claim 1, wherein the first magnetic part is a magnet and the second magnetic part consists of two permanent magnets arranged in the implanted casing so as to present north-south magnetic axes substantially perpendicular to the surface of the patient's skin at said location, and in opposite directions, these magnetic axes being spaced apart by a distance substantially corresponding to the distance between the poles of the first magnetic part.

7. The auditory aid device according to claim 1, wherein the second magnetic part consists of at least two permanent magnets arranged in the implanted casing so as to present north-south magnetic axes substantially perpendicular to the surface of the patient's skin at said location, and alternatively in opposite directions, and the first magnetic part includes as many permanent magnets as the first part, the magnets of the first magnetic part being arranged in the casing so as to present north-south magnetic axes substantially perpendicular to the wall of the external casing designed to come in contact with the patient's skin, and alternatively in opposite directions, the magnetic axes of the magnets arranged in the external casing being distributed in a plane substantially parallel to said wall in a configuration substantially corresponding to the distribution configuration of the magnetic axes of the magnets in the implanted casing.

8. The auditory aid device according to claim 1, wherein the second casing is designed to be implanted in the temporal-occipital area of the patient's skull.

9. The auditory aid device according to claim 1, wherein the earphone is installed in the external casing and connected to the external auditory canal of the patient by an acoustic tube comprising an intra-auricular end, the auditory aid device comprising in addition a mechanical anti-Larsen absorption system.

10. The auditory aid device according to claim 1, wherein the earphone is placed in the external auditory canal of the patient and forms an intra-auricular end of the connection, the connection being made by an electrical cable.

11. The auditory aid device according to claim 9, wherein the intra-auricular end of the connection is maintained in the external auditory canal of the patient by means of an intra-auricular support comprising means for centering and maintaining said end in the auditory canal.

12. The auditory aid device according to claim 1, wherein the external casing consists of a base and a cover rotatably mounted on the base, and means for locking the angular position of the cover with respect to the base, the second magnetic part being fixed to the base, while the microphone(s) are fixed to the cover.

13. The auditory aid device according to claim 1, wherein the implanted casing is connected to at least two electrodes for collection of evoked or spontaneous auditory potentials, the implanted casing containing at least one electronic module for signal collection and processing connected to the collection electrodes, a transmission module connected to an antenna and to the collection and processing module, to transmit to the external casing the signals produced by the collection module as a function of the signals collected by the electrodes, and an electrical power supply.

14. The auditory aid device according to claim 13, wherein one of the collection electrodes is designed to be installed on the round window of the middle ear of the patient.

15. The auditory aid device according to claim 1, wherein the implanted casing is connected to at least one active stimulation electrode designed to be positioned in proximity to the inner ear of the patient or in the cochlea, the implanted casing containing at least an electronic stimulation module connected to the stimulation electrodes, a transmission module connected to an antenna and to the stimulation module, the stimulation module being designed to generate electrical stimulation signals that are applied to the stimulation electrodes from signals received from the external casing through the transmission module, via the antenna located in the implanted casing.

16. The auditory aid device according to claim 15, wherein one of the active stimulation electrodes is designed to be installed on the round window of the middle ear of the patient.

17. The auditory aid device according to claim 13, wherein the collection electrodes and stimulation electrodes are at least partially common.

18. The auditory aid device according to claim 13, wherein the external casing further comprises a module for signal transmission connected to at least an antenna and to the electronic module.

19. The auditory aid device according to claim 14, wherein the implanted casing is connected to at least one electromechanical transducing vibrator designed to be positioned in a bony or cartilaginous area in proximity to the inner ear of the patient, the implanted casing containing at least an electronic stimulation module connected to the vibrator, the transmission module connected to the antenna and to the stimulation module, the stimulation module being designed to generate electrical stimulation signals that are applied to the vibrator from the signals received from the external casing through the transmission module, via the antenna located in the implanted casing.

* * * * *